US005221182A

United States Patent [19]

Arbeus

[11] Patent Number: 5,221,182

[45] Date of Patent: Jun. 22, 1993

[54] VANE APPARATUS FOR CLOG RESISTANT PUMP

[75] Inventor: Ulf Arbeus, Lidingo, Sweden

[73] Assignee: ITT Flygt AB, Solna, Sweden

[21] Appl. No.: 955,230

[22] Filed: Oct. 1, 1992

Related U.S. Application Data

[63] Continuation of Ser. No. 762,518, Sep. 18, 1991, abandoned.

[30] Foreign Application Priority Data

Sep. 12, 1990 [SE] Sweden ..... 9002898

[51] Int. Cl.[5] ..... F01D 9/00

[52] U.S. Cl. ..... 415/208.1; 415/211.2

[58] Field of Search ..... 415/208.1, 208.2, 208.3, 415/208.4, 211.2, 191, 914

[56] References Cited

U.S. PATENT DOCUMENTS

| | | | |
|---|---|---|---|
| 1,971,386 | 8/1934 | Schmidt | 415/211.2 |
| 2,139,594 | 12/1938 | Kort | 415/208.2 |
| 2,311,896 | 2/1943 | Criqui | 415/208.1 |
| 2,897,375 | 7/1959 | Fevre | 415/208.2 |
| 3,279,384 | 10/1966 | Jakat et al. | 415/208.2 |
| 3,389,558 | 6/1968 | Hall | 415/211.2 |
| 3,951,565 | 4/1976 | Rothe et al. | 415/208.2 |

FOREIGN PATENT DOCUMENTS

| | | | |
|---|---|---|---|
| 138275 | 8/1950 | Australia | 415/190 |
| 556572 | 4/1957 | Belgium | 415/191 |
| 1373896 | 2/1988 | U.S.S.R. | 415/208.1 |
| 200269 | 7/1923 | United Kingdom | 415/208.1 |
| 389510 | 3/1933 | United Kingdom | 415/185 |

*Primary Examiner*—John T. Kwon

*Attorney, Agent, or Firm*—Menotti J. Lombardi

[57] ABSTRACT

The vanes (6) of a pump housing (5) are designed with strongly back swept leading edges (7) as seen in the direction of the flow, the vanes (6) being given a bulb form in the outward direction.

1 Claim, 1 Drawing Sheet

VANE APPARATUS FOR CLOG RESISTANT PUMP

This application is a continuation of application Ser. No. 07/762,518, filed Sep. 18, 1991, now abandoned.

BACKGROUND OF THE INVENTION

This invention relates to vane apparatus for clog resistant pumps. Such pumps may roughly be categorized as centrifugal pumps and axial pumps.

The centrifugal pump comprises an impeller consisting of a hub, at least one cover disc on said hub and a number of vanes, a so-called open impeller. A closed impeller is provided with two cover discs and intermediate vanes. Common for the two types is that the liquid is sucked into the centre of the impeller in an axial direction and leaves it tangentially at the periphery.

The axial flow pump differs from the centrifugal pump in that the liquid leaves the pump in a substantially axial direction. This linking of the fluid is taken care of by a number of vanes in the pump housing after the impeller. These vanes also normally serve as supporting elements in the housing construction.

When pumping sewage water and certain types of process water containing elongated fibres, the pumping may be disturbed by rags, fibres, etc., getting stuck to the front edges of the vanes on the impeller and in the pump housing. Such build-ups can initially create vibrations in the pump, consequently the efficiency decreases and finally the pump might get totally clogged. One way to make the objects leave the vanes is to let the pump rotate backwards at certain intervals, but this is of course not an acceptable solution. Another way to diminish the clogging risk is to provide the pump with cutting means which divide the pollutions into pieces before they are sucked into the impeller. An example of such a solution is shown in the Swedish Pat No 820 5774-6 (U.S. Pat. No. 4,640,666). A disadvantage with this solution is that the cutting means may be quickly worn out which might cause the clogging problem to become even worse.

The purpose of this invention is to solve the clogging problems mentioned above in a totally new and different way. The solution is obtained by help of the apparatus described herein.

SUMMARY OF THE INVENTION

An object of the invention is to provide vane apparatus for a non-clogging pump of centrifugal or axial flow type.

According to the broader aspects of the invention, the vanes of the pump housing are designed with strongly back swept leading edges as seen in the direction of the flow, and the vanes are given a bulb form in the outward direction.

BRIEF DESCRIPTION OF THE DRAWINGS

Other objects and advantages of the invention will be more fully apparent from the following description, claims, and drawings in which:

DETAILED DESCRIPTION OF THE PREFERRED EMBODIMENT

Figure 1:
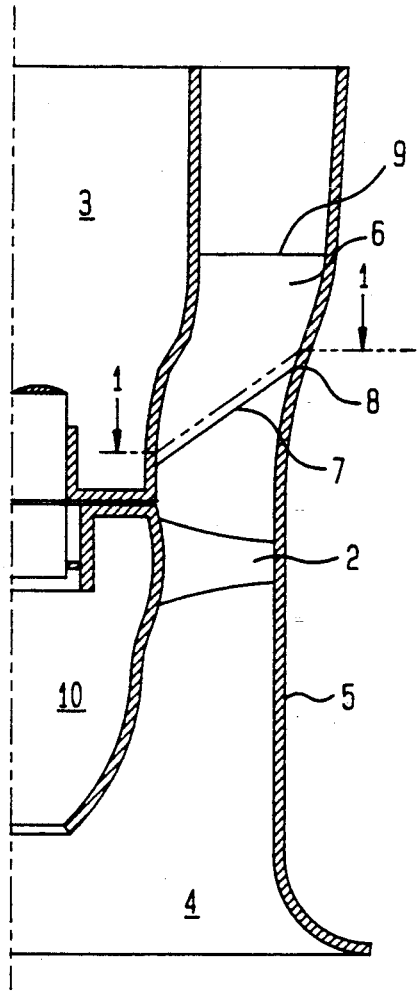
FIG. 1 is an axial view of the vanes in an axial flow pump according to the invention.
Figure 2:
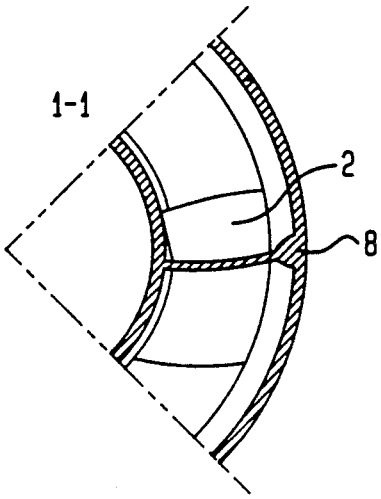
FIG. 2 is a meridious cut taken along lines 1—1 of FIG. 1.

Referring to FIG. 1, there is illustrated an impeller hub 10 provided with additional vanes 2, a motor unit 3, an annular channel 4. Pump housing 5 and vanes 6 having leading edges 7 and bulbs 8. In operation, the rotating impeller vanes 2 suck the liquid through the annular channel 4. When the liquid has passed vanes 2 it is linked by the vanes 6 for obtaining pressure energy.

In order to diminish the risk that fibres and the like will clog on the leading edge 7 of the additional vane 6, the latter is designed strongly swept backwards, as seen in the direction of the flow, causing the fibres to slip outwards in the direction of the wall 5 of the pump housing where the velocity is the highest. In addition, the additional vane is designed with a bulb portion 8 having increased thickness towards the wall of housing 5 and with decreasing thickness towards the trailing edge 9 which is transverse to the direction of the flow. In this way the fibres easily slip over the edge of the vane and the bulb has only a slight influence on the flow as a whole. In order to prevent solid material from getting stuck in the transition between leading edge 7 and wall 5, said part is designed with a radius and no sharp corners.

By help of the invention is obtained a device which considerably diminishes the risk for clogging in pumps operating with liquids containing fibres, rugs, etc.

While the present invention has been disclosed in connection with a preferred embodiment thereof, the scope of the invention is defined by the claims.

I claim:

1. A pump of the axial flow type for pumping liquid containing pollutants such as elongated fibers, which pump comprises in combination:

a motor (3) for driving an impeller having a impeller hub (10) with vanes (2) extending from said hub (10);

a pipe formed pump housing (5) surrounding said motor (3) and vanes (2) and forming an annular channel therebetween for conveying the pumped liquid in the rearward flow direction from said hub (10);

said housing (5) having attaching means (6) acting as additional vanes and being supportably attached to the housing of said motor (3), said means (6) being axially displaced and rearward of said hub (10) and vanes (2); and said means (6) being formed with a leading edge (7) swept rearward in the direction of flow and a trailing edge which is transverse to the direction of flow and having a bulb portion (8) with increased thickness adjacent the housing (5) and with decreasing thickness toward the trailing edge of means (6).

* * * * *